US009816524B2

(12) United States Patent
Tamaki

(10) Patent No.: US 9,816,524 B2
(45) Date of Patent: Nov. 14, 2017

(54) CENTRIFUGAL COMPRESSOR

(71) Applicant: IHI Corporation, Tokyo (JP)

(72) Inventor: Hideaki Tamaki, Tokyo (JP)

(73) Assignee: IHI CORPORATION (JP)

( * ) Notice: Subject to any disclaimer, the term of this patent is extended or adjusted under 35 U.S.C. 154(b) by 293 days.

(21) Appl. No.: 14/372,074

(22) PCT Filed: Jan. 23, 2013

(86) PCT No.: PCT/JP2013/051246
§ 371 (c)(1),
(2) Date: Jul. 14, 2014

(87) PCT Pub. No.: WO2013/111761
PCT Pub. Date: Aug. 1, 2013

(65) Prior Publication Data

US 2015/0056062 A1 Feb. 26, 2015

(30) Foreign Application Priority Data

Jan. 23, 2012 (JP) ..... 2012-010788

(51) Int. Cl.
*F04D 29/44* (2006.01)
*F04D 17/10* (2006.01)
(Continued)

(52) U.S. Cl.
CPC ..... *F04D 29/441* (2013.01); *F04D 17/10* (2013.01); *F04D 27/009* (2013.01);
(Continued)

(58) Field of Classification Search
CPC ..... F04D 17/10; F04D 29/009
See application file for complete search history.

(56) References Cited

U.S. PATENT DOCUMENTS

2005/0152775 A1 7/2005 Japikse et al. ..... 415/1
2007/0269308 A1 11/2007 Wood
(Continued)

FOREIGN PATENT DOCUMENTS

CN 101737359 A 6/2010
CN 101749278 A 6/2010
(Continued)

OTHER PUBLICATIONS

Office Action dated Sep. 29, 2015 issued in corresponding Chinese Patent Application No. 201380006003.X (with English translation of only a part of the Search Report).
International Search Report and Written Opinion dated Apr. 23, 2013 in corresponding PCT International Application No. PCT/JP2013/051246.
(Continued)

*Primary Examiner* — Craig Kim
*Assistant Examiner* — Michael Sehn
(74) *Attorney, Agent, or Firm* — Ostrolenk Faber LLP

(57) ABSTRACT

The centrifugal compressor (1) includes: an impeller (3); and a casing (2) accommodating the impeller (3). The casing (2) includes: an inlet (6); an impeller-accommodating portion (14) in which the impeller (3) is disposed; an annular chamber (11) formed around the inlet (6); a downstream groove (13) communicating a downstream end portion of the annular chamber (11) with the impeller-accommodating portion (14); and an upstream groove (12) communicating an upstream end portion of the annular chamber (11) with the inlet (6). In addition, the downstream groove (13) is provided in a predetermined range in a circumferential direction of the impeller (3) so as to communicate with a high-pressure part to occur in part of the impeller-accommodating portion (14), and the upstream groove (12) is provided over the entire circumference of the inlet (6).

6 Claims, 4 Drawing Sheets

(51) Int. Cl.

| | |
|---|---|
| ***F04D 27/02*** | (2006.01) |
| ***F04D 29/68*** | (2006.01) |
| ***F04D 29/42*** | (2006.01) |
| ***F04D 27/00*** | (2006.01) |

(52) U.S. Cl.
CPC ..... *F04D 27/0207* (2013.01); *F04D 29/4213* (2013.01); *F04D 29/685* (2013.01)

(56) References Cited

U.S. PATENT DOCUMENTS

| | | | | |
|---|---|---|---|---|
| 2010/0172741 | A1* | 7/2010 | Hosoya ..... | F04D 27/0207<br>415/119 |
| 2011/0088392 | A1 | 4/2011 | Sumser et al. ..... | 60/605.1 |

FOREIGN PATENT DOCUMENTS

| | | | |
|---|---|---|---|
| CN | 201531461 | U | 7/2010 |
| CN | 102182710 | A | 9/2011 |
| JP | 2003-106299 | | 4/2003 |
| JP | 2004-144029 | | 5/2004 |
| JP | 2004-332734 | | 11/2004 |
| JP | 2011-080401 | | 4/2011 |
| JP | 2012-154200 | | 8/2012 |
| WO | WO 2011/099418 | A1 | 8/2011 |

OTHER PUBLICATIONS

Search Report dated Aug. 4, 2015 issued in corresponding European Patent Application No. 13746803.5.

* cited by examiner

CENTRIFUGAL COMPRESSOR

CROSS-REFERENCE TO RELATED APPLICATIONS

The present application is a 35 U.S.C. §§371 national phase conversion of PCT/JP2013/051246, filed Jan. 23, 2013, which claims priority to Japanese Patent Application No. 2012-010788, filed Jan. 23, 2012, the contents of which are incorporated herein by reference. The PCT International Application was published in the Japanese language.

TECHNICAL FIELD

The present invention relates to a centrifugal compressor which increases the pressure of a compressible fluid.

BACKGROUND ART

In order to increase the pressure of a compressible fluid, for example, a centrifugal compressor is used. The operation range of a centrifugal compressor may be limited, because surging occurs due to a reverse flow or the like of a fluid while the flow rate thereof is low (when the flow rate of the fluid is decreased in order to increase the pressure of the fluid). When the surging occurs, the operation of the centrifugal compressor becomes unstable. Accordingly, if the surging is suppressed, the operation range of the centrifugal compressor can be extended.

As one means of suppressing surging, casing treatment disclosed in Patent Document 1 is used.

A centrifugal compressor includes an impeller rotating at a high speed, and a casing which accommodates the impeller and in which a scroll passageway is formed around the impeller. In the casing treatment disclosed in Patent Document 1, the wall surface of the casing adjacent to the upstream end of the impeller is provided with a groove formed over the entire circumference of the wall surface, and the groove is communicated with a flow passageway positioned upstream of the impeller. While the flow rate of a fluid is low, a fluid reversely flows upstream of the impeller through the groove from a high-pressure part which locally occurs in an impeller-accommodating portion of the casing, and by recirculating part of fluid, the fluid is prevented from reversely flowing in the impeller-accommodating portion, thereby suppressing the surging.

Using the casing treatment as described above, the effect of suppressing surging is obtained. On the other hand, since a downstream fluid is recirculated upstream, the pressure ratio (the ratio of the suction pressure to the discharge pressure of a compressor) during a low-flow rate is decreased compared to a case where casing treatment is not performed.

DOCUMENT OF RELATED ART

Patent Document

[Patent Document 1] Japanese Patent Application, First Publication No. 2004-332734

SUMMARY OF INVENTION

Technical Problem

The present invention was made in view of the above circumferences, and an object thereof is to provide a centrifugal compressor capable of preventing reduction of a discharge pressure and of a discharge flow rate while the flow rate of a fluid is low even when performing casing treatment in order to prevent surging and to extend the operation range.

Solution to Problem

According to a first aspect of the present invention, a centrifugal compressor includes: an impeller; and a casing accommodating the impeller. The casing includes: an inlet; an impeller-accommodating portion in which the impeller is disposed; an annular flow passageway formed around the impeller; an outlet communicating with the annular flow passageway; an annular chamber formed around the inlet; a downstream groove communicating a downstream end portion of the annular chamber with the impeller-accommodating portion; and an upstream groove communicating an upstream end portion of the annular chamber with the inlet. In addition, the downstream groove is provided in a predetermined range in a circumferential direction of the impeller so as to communicate with a high-pressure part to occur in part of the impeller-accommodating portion, and the upstream groove is provided over the entire circumference of the inlet.

According to a second aspect of the present invention, in the first aspect, the casing includes a tongue portion formed between the outlet and the annular flow passageway. In addition, the downstream groove is formed to be included in a range from a position of 45° upstream with respect to a reference radial line connecting a rotation center of the impeller and the tongue portion, to a position of 75° downstream with respect to the reference radial line.

Effects of Invention

According to the present invention, a centrifugal compressor includes: an impeller; and a casing accommodating the impeller. The casing includes: an inlet; an impeller-accommodating portion in which the impeller is disposed; an annular flow passageway formed around the impeller; an outlet communicating with the annular flow passageway; an annular chamber formed around the inlet; a downstream groove communicating a downstream end portion of the annular chamber with the impeller-accommodating portion; and an upstream groove communicating an upstream end portion of the annular chamber with the inlet. In addition, the downstream groove is provided in a predetermined range in a circumferential direction of the impeller so as to communicate with a high-pressure part to occur in part of the impeller-accommodating portion, and the upstream groove is provided over the entire circumference of the inlet.

Therefore, a recirculation flow is formed from the high-pressure part which occurs in part of the impeller-accommodating portion and in which a reverse flow of a fluid is easily generated, and the surging is efficiently prevented. Furthermore, the downstream groove is formed in part in the circumferential direction of the casing (the part facing the high-pressure part), and the recirculation flow is formed from the downstream groove having this configuration, and thus, the recirculation flow rate of a fluid is suppressed to be less than in the related art. Consequently, an excellent effect that the reduction of a discharge pressure and of the maximum discharge flow rate due to the recirculation can be prevented is obtained.

DESCRIPTION OF EMBODIMENTS

Hereinafter, embodiments of the present invention are described with reference to the drawings.

First, the outline of a centrifugal compressor according to an embodiment of the present invention is described with reference to FIG. 1.

Figure 1:
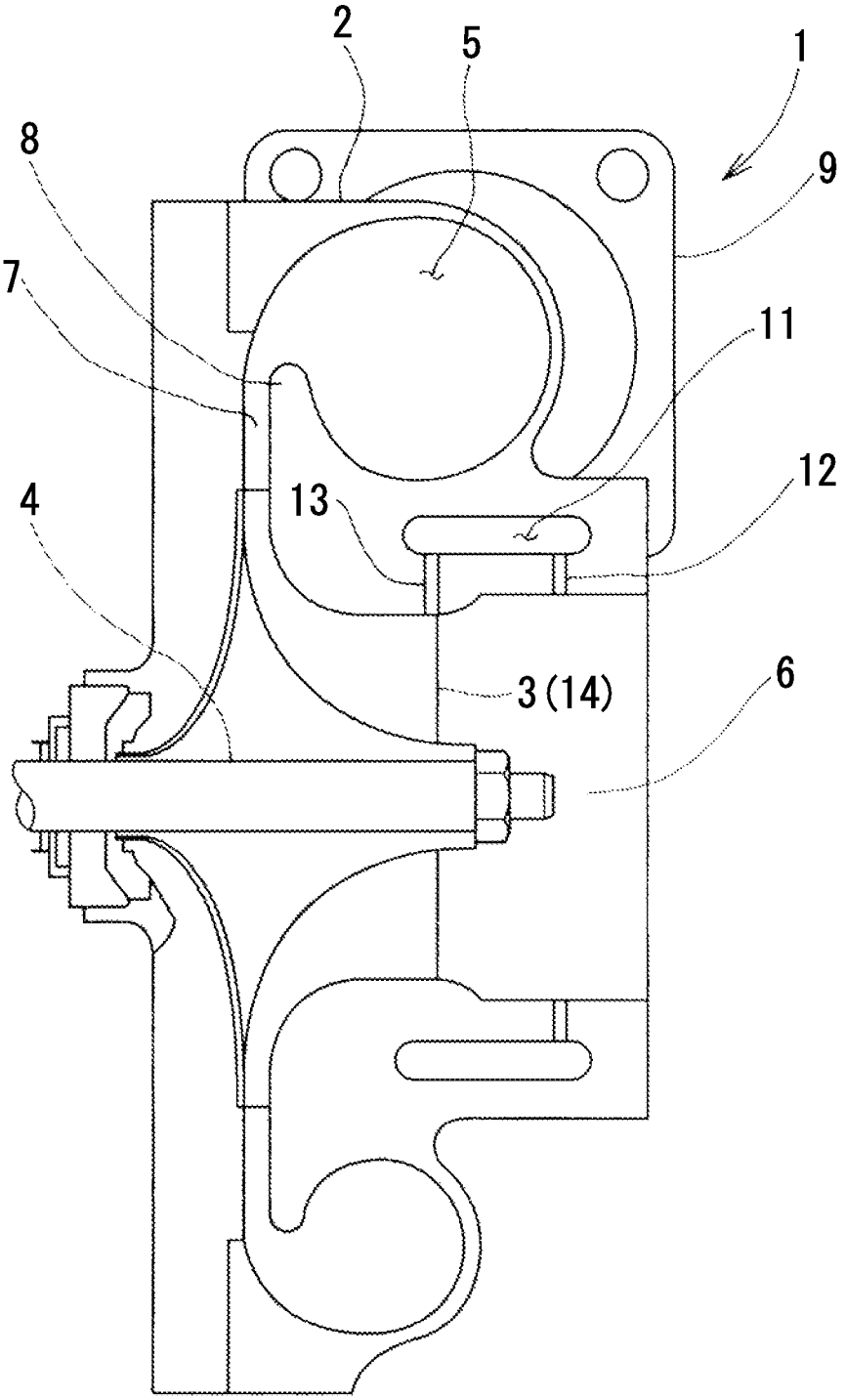
FIG. 1 is a cross-sectional view of a centrifugal compressor according to an embodiment of the present invention.

In FIG. 1, reference signs 1, 2 and 3 represent a centrifugal compressor, a casing and an impeller which is accommodated in the casing, respectively. That is, a centrifugal compressor 1 includes an impeller 3, and a casing 2 accommodating the impeller 3.

The impeller 3 is fixed to one end portion of a rotary shaft 4 which is rotatably supported by a bearing housing (not shown). A turbine (not shown) which generates driving force used to rotate the impeller 3 is connected to the other end portion of the rotary shaft 4. Moreover, the component used to rotate the impeller 3 is not limited to a turbine, and may be a motor or the like.

An annular flow passageway 5 is formed in the casing 2 around the impeller 3, and an outlet 9 is communicated with a certain position of the annular flow passageway 5, wherein the outlet 9 discharges a compressible fluid whose pressure has been increased (e.g., compressed air). An inlet 6 is formed in the center of the casing 2 so as to face the impeller 3 and to be arranged coaxially with the impeller 3.

That is, the casing 2 includes the inlet 6 through which a compressible fluid is suctioned, an impeller-accommodating portion 14 which communicates with the inlet 6 and in which the impeller 3 is disposed, the annular flow passageway 5 formed around the impeller 3, and the outlet 9 communicating with the annular flow passageway 5. Moreover, a fluid flows from the inlet 6 to the impeller-accommodating portion 14 approximately in the axis direction of the rotary shaft 4, and accordingly, the right in FIG. 1 may be referred to as "upstream in the axis direction", and the left in FIG. 1 may be referred to as "downstream in the axis direction".

In the casing 2, a diffuser 7 is formed around the impeller 3 and communicates with the annular flow passageway 5.

The diffuser 7 has a ring-shaped space which communicates the impeller-accommodating portion 14 and the annular flow passageway 5 to each other, wherein the impeller-accommodating portion 14 has a space accommodating the impeller 3 in the casing 2. A partition wall 8 is formed between the annular flow passageway 5 and the diffuser 7.

The turbine is rotated by exhaust gas from an engine (not shown), and the impeller 3 is rotated by rotational driving force transmitted through the rotary shaft 4. The impeller 3 provided coaxially with the turbine is rotated, and air (a compressible fluid, combustion air for the engine) is suctioned through the inlet 6. The suctioned air is sent outward in the radial direction by the rotation of the impeller 3 and is compressed by passing through the diffuser 7, and thereafter, flows into the annular flow passageway 5. The compressed air is discharged from the annular flow passageway 5 through the outlet 9 to the outside of the centrifugal compressor 1. The discharged air is supplied to the engine.

Next, the casing treatment of this embodiment is described.

In the casing 2, an annular chamber 11 disposed coaxially with the inlet 6 is formed. That is, the casing 2 includes the annular chamber 11 which is formed around the inlet 6. The annular chamber 11 has a cylindrical space extending in the central axis direction of the inlet 6. The upstream end of the annular chamber 11 (the upstream end portion in the axis direction, the right end in FIG. 1) is positioned further upstream (upstream in the axis direction) than the upstream end of the impeller 3, and the downstream end of the annular chamber 11 (the downstream end portion in the axis direction, the left end in FIG. 1) is positioned further downstream (downstream in the axis direction) than the upstream end of the impeller 3.

The upstream end of the annular chamber 11 communicates with the inlet 6 through an upstream groove 12. That is, the casing 2 includes the upstream groove 12 which communicates the upstream end of the annular chamber 11 to the inlet 6. The upstream groove 12 is provided over the entire circumference of the inlet 6. Moreover, the upstream groove 12 may be a ring-shaped groove formed continuously in the circumferential direction, and may be a groove formed continuously in the circumferential direction in which ribs (reinforcement members) are provided at certain intervals. Furthermore, the upstream groove 12 may be an opening portion in which long holes are disposed at certain intervals, wherein the long hole extends in the circumferential direction, and may be an opening portion in which circular holes or rectangular holes are disposed at certain intervals.

The downstream end of the annular chamber 11 communicates with the impeller-accommodating portion 14 through a downstream groove 13. That is, the casing 2 includes the downstream groove 13 which communicates the downstream end of the annular chamber 11 to the impeller-accommodating portion 14. The downstream groove 13 is formed on the wall surface of the casing 2 adjacent to the upstream end of the impeller 3. In other words, the downstream groove 13 is formed on the wall surface of the casing 2 facing the upstream end of the impeller 3. The downstream groove 13 is provided in a predetermined range in the circumferential direction of the impeller 3.

The cross-sectional shape of the annular chamber 11 along a plane including the central axis of the rotary shaft 4 is a shape to which the upstream groove 12 and the downstream groove 13 are connected, and is, for example, an oval shape extending in the central axis direction as shown in FIG. 1.

The shape of the annular flow passageway 5 in the casing 2 is non-axial symmetry. In other words, the cross-sectional shape of the annular flow passageway 5 along a plane including the central axis of the rotary shaft 4 is changed at each position in the circumferential direction of the impeller 3. Accordingly, the pressure inside the annular flow passageway 5 is not uniform at each position in the circumferential direction, and the annular flow passageway 5 has pressure distribution different at each position in the circumferential direction. Furthermore, the circumferential edge of the impeller 3 also has a pressure distribution different at each position in the circumferential direction, and the pressure distribution of the annular flow passageway 5 is propagated through the diffuser 7 to the impeller-accommodating portion 14 in which the impeller 3 is disposed. That is, the inside of the impeller-accommodating portion 14 also has a pressure distribution different at each position in the circumferential direction, and thus, it is conceivable that a high-pressure part occurs in part of the inside of the impeller-accommodating portion 14.

The downstream groove 13 is provided in a range in which the inside of the impeller-accommodating portion 14 locally has a high pressure. That is, the downstream groove 13 is provided in a predetermined range in the circumferential direction of the impeller 3 so as to communicate with a high-pressure part which occurs in part of the inside of the impeller-accommodating portion 14.

Furthermore, the downstream groove 13 is described in detail.

The position and range in the circumferential direction in which the downstream groove 13 is provided are described with reference to FIGS. 2 and 3.

Figure 2:
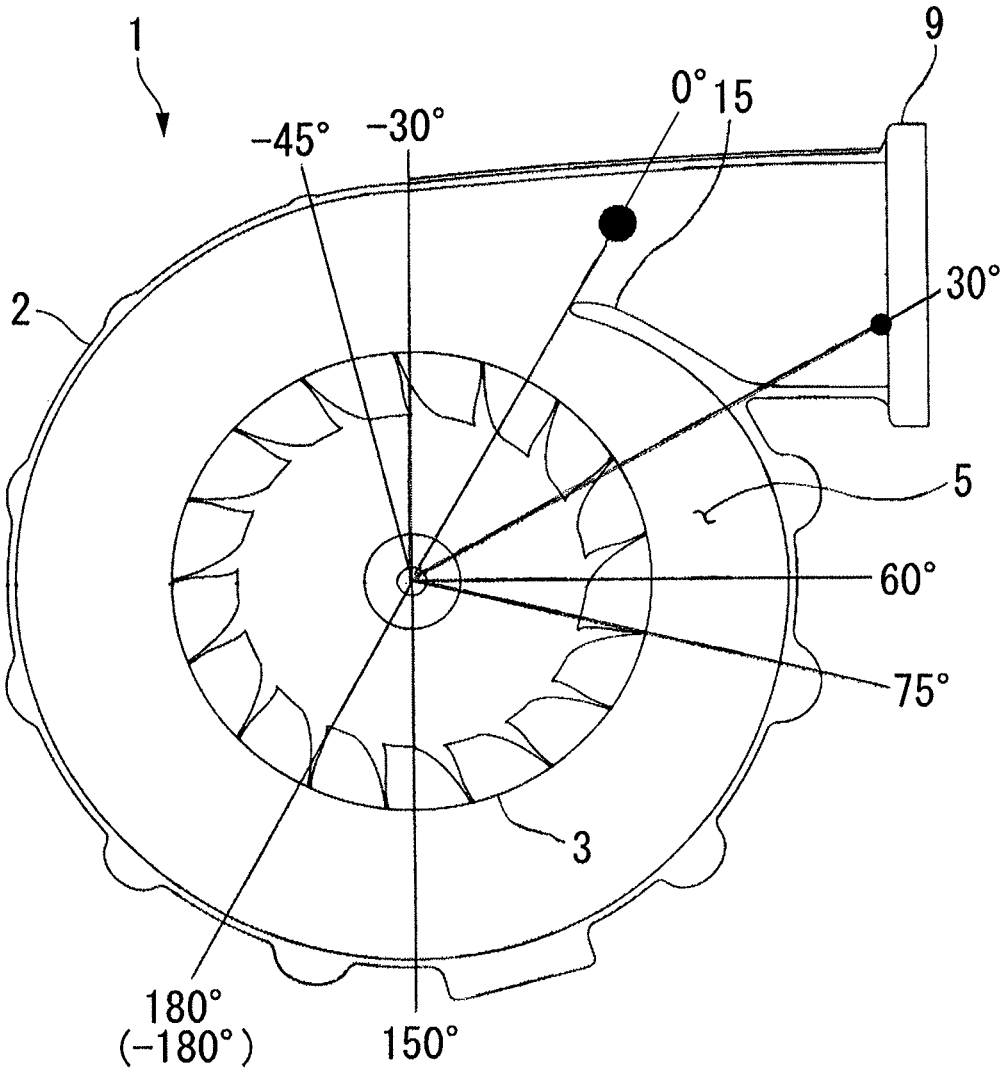
FIG. 2 is a schematic diagram showing the formation range of a groove used for casing treatment of this embodiment.

FIG. 2 is a schematic diagram showing the formation range of the downstream groove 13 used for the casing treatment of this embodiment, and is a diagram viewed in the central axis direction of the impeller 3.

In FIG. 2, the formation range of the downstream groove 13 is described using the rotation center of the impeller 3 as a reference. Moreover, since a fluid inside the annular flow passageway 5 of FIG. 2 flows in the clockwise direction in FIG. 2 due to rotation of the impeller 3, a position shifted in the clockwise direction from a certain position may be referred to as "downstream in the circumferential direction", and a position shifted in the counter-clockwise direction from a certain position may be referred to as "upstream in the circumferential direction".

In FIG. 2, a reference sign 15 represents a tongue portion which is formed between the outlet 9 and the annular flow passageway 5. In the following description, the position of the tongue portion 15 is shown as 0°, and the opposite position to the tongue portion 15 across the rotation center of the impeller 3 is shown as 180° (or −180°). An angle downstream in the circumferential direction from the tongue portion 15 is represented by a positive value, and an angle upstream in the circumferential direction from the tongue portion 15 is represented by a negative value. In addition, more precisely, the position of the upstream end in the circumferential direction of the tongue portion 15 is shown as 0°.

The downstream groove 13 is formed so as to be included in the range from the position which is at 45° upstream (in the counter-clockwise direction) from the tongue portion 15, to the position which is at 120° in the clockwise direction from the above position of 45° (in FIG. 2, the range from the position of −45° to the position of +75° interposing the tongue portion 15 therebetween), and the annular chamber 11 is communicated with the impeller-accommodating portion 14 through the downstream groove 13, and thus, the surging-suppressing effect is obtained.

Moreover, the range in which the downstream groove 13 is provided is determined based on the pressure distribution of the circumferential edge of the impeller 3 (based on the position and range in which a local high-pressure part occurs). Since the pressure distribution is changed due to the shape, the characteristics or the like of the impeller 3, the upstream end in the circumferential direction of the downstream groove 13 may not be disposed at the position of 45° upstream from the tongue portion 15.

However, in general, a local high-pressure part occurs in the vicinity of the tongue portion 15, for example, in the range between the positions of ±45° with respect to the tongue portion 15. Accordingly, it is preferable that the downstream groove 13 be provided in the range from the position of −45° to the position of +75° with respect to a line connecting the tongue portion 15 and the rotation center of the impeller 3 (a reference radial line: the radial line across the position of 0° in FIG. 2). Furthermore, it is more preferable that the downstream groove 13 be provided in the range of ±45° with respect to the above reference radial line.

Figure 3:
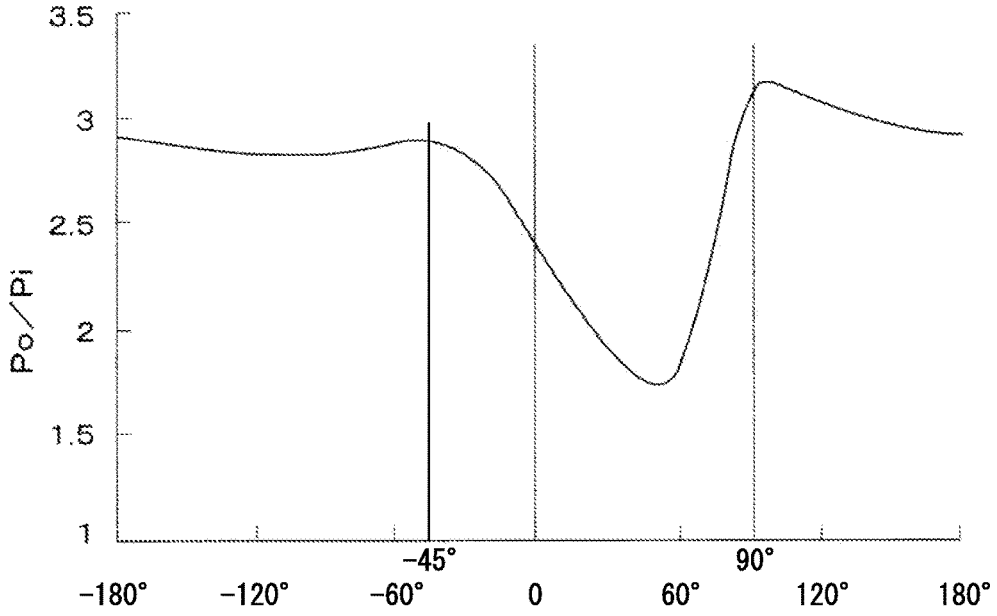
FIG. 3 is a graph showing a pressure ratio of an inflow section to an outflow section of an impeller when casing treatment is not performed.

FIG. 3 is a graph showing a pressure ratio of an inflow section to an outflow section of the impeller 3 when casing treatment is not performed in the centrifugal compressor 1 of this embodiment. Moreover, angles on the horizontal axis of FIG. 3 are set using the same rule as in FIG. 2, and therefore, the position of 0° corresponds to the position of the tongue portion 15. When the static pressure at the outflow section of the impeller 3 (the area near the diffuser 7 in the vicinity of the impeller 3) is Po and the static pressure at the inflow section of the impeller 3 (the area near the inlet 6 in the vicinity of the impeller 3) is Pi, the pressure ratio of FIG. 3 is represented by Po/Pi. When a high-pressure part locally occurs in the area near the inlet 6 in the vicinity of the impeller 3, the Pi at the area increases, and thus, the pressure ratio Po/Pi decreases. In other words, it is conceivable that a high-pressure part occurs in the range in which the pressure ratio of FIG. 3 decreases, in part of the impeller-accommodating portion 14 near the inlet 6.

In FIG. 3, the pressure ratio (the fluid outflow section pressure Po/the fluid inflow section pressure Pi of the impeller 3) is minimized in the vicinity of the position of 60° downstream from the tongue portion 15. Usually, the pressure ratio is minimized at a downstream position of the tongue portion 15 (e.g., the position of +60°), but since the route transmitting pressure is changed depending on the shape or the like of the casing 2, it is difficult to accurately determine the downstream position of the tongue portion 15 in which the pressure ratio is minimized. However, the position of the tongue portion 15 and the position of the minimized pressure ratio are related to each other, and therefore, in many cases, the position of the minimized pressure ratio exists in the range from the position of 0° to the position of +75° of downstream with respect to the position of the tongue portion 15.

Figure 4:
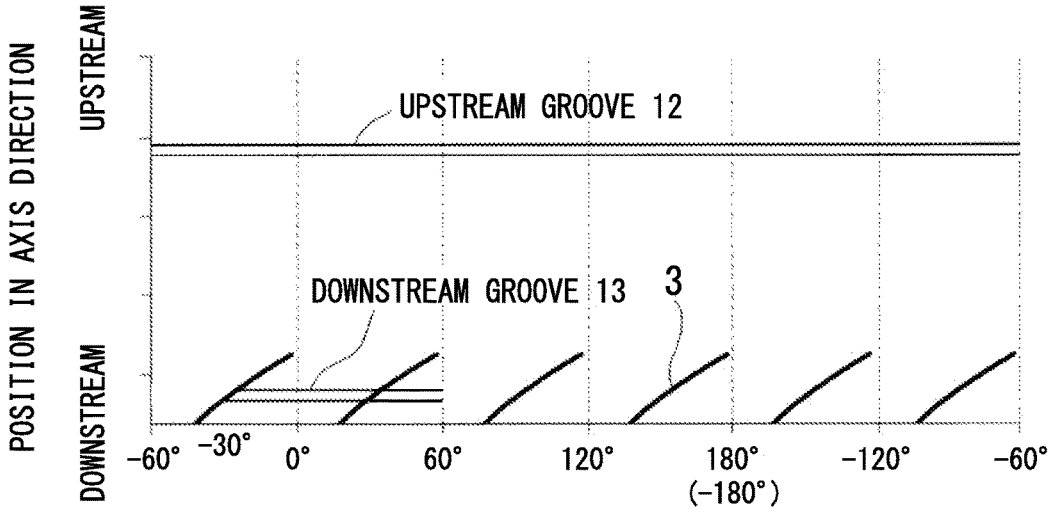
FIG. 4 is a schematic diagram showing a positional relationship between an upstream groove and a downstream groove according to this embodiment.

Next, FIG. 4 is a schematic diagram showing a positional relationship between the upstream groove 12 and the downstream groove 13. In this embodiment, the upstream groove 12 is provided over the entire circumference of the inlet 6, and the downstream groove 13 is provided in the range from the position of −30° to the position of +60° (refer to FIG. 2). Moreover, angles on the horizontal axis of FIG. 4 are also set using the same rule as in FIG. 2. When the pressure ratio of FIG. 3 and the range in which the downstream groove 13 of FIG. 4 is provided are contrasted, the downstream groove 13 is provided in the range in which the pressure ratio decreases. Empirically, a high-pressure part locally occurring in the impeller-accommodating portion 14 tends to be generated so as to correspond to the position in which the pressure ratio of the inflow section to the outflow section of the impeller 3 decreases. Accordingly, the range in which the downstream groove 13 is preferably provided is the sum of the range from 0° to +75° including the position in which the pressure ratio is minimized as described above, and the range from the tongue portion 15) (0°) to the position of 45° upstream from the tongue portion 15 (−45° in FIGS. 2 and 3) based on FIG. 3. That is, the downstream groove 13 is formed so as to be included in the range from the position of 45° upstream from the tongue portion 15, to the position of 75° downstream from the tongue portion 15. In addition, the width in the circumferential direction of the downstream groove 13 of this embodiment is greater than or equal to the arc corresponding to 60° and is less than or equal to the arc corresponding to 90°.

The pressure ratio of FIG. 3 decreases in the range from the position of −45° to the position of +90°. Based on this result, the downstream groove 13 may be formed so as to be included in the range from the position of 45° upstream from the tongue portion 15, to the position of 90° downstream from the tongue portion 15.

The upstream end of the impeller 3 is disposed in an area in the impeller-accommodating portion 14, and the area and the inlet 6 are communicated with each other through the downstream groove 13, the annular chamber 11 and the upstream groove 12. Therefore, while the flow rate of a fluid is low, a fluid reversely flows upstream of the impeller 3 through the annular chamber 11 from a high-pressure part locally occurring in the impeller-accommodating portion 14 and is supplied from the upstream groove 12 into the inlet 6, thereby forming a partial recirculation flow, and thus, the surging is prevented.

Furthermore, the downstream groove 13 is provided so as to be limited to a predetermined range and to communicate with a high-pressure part locally occurring in the impeller-accommodating portion 14, and thus, the recirculation flow rate of a fluid is decreased, and the pressure reduction at the outflow section of the impeller 3 while the flow rate of a fluid is low is prevented.

Figure 5:
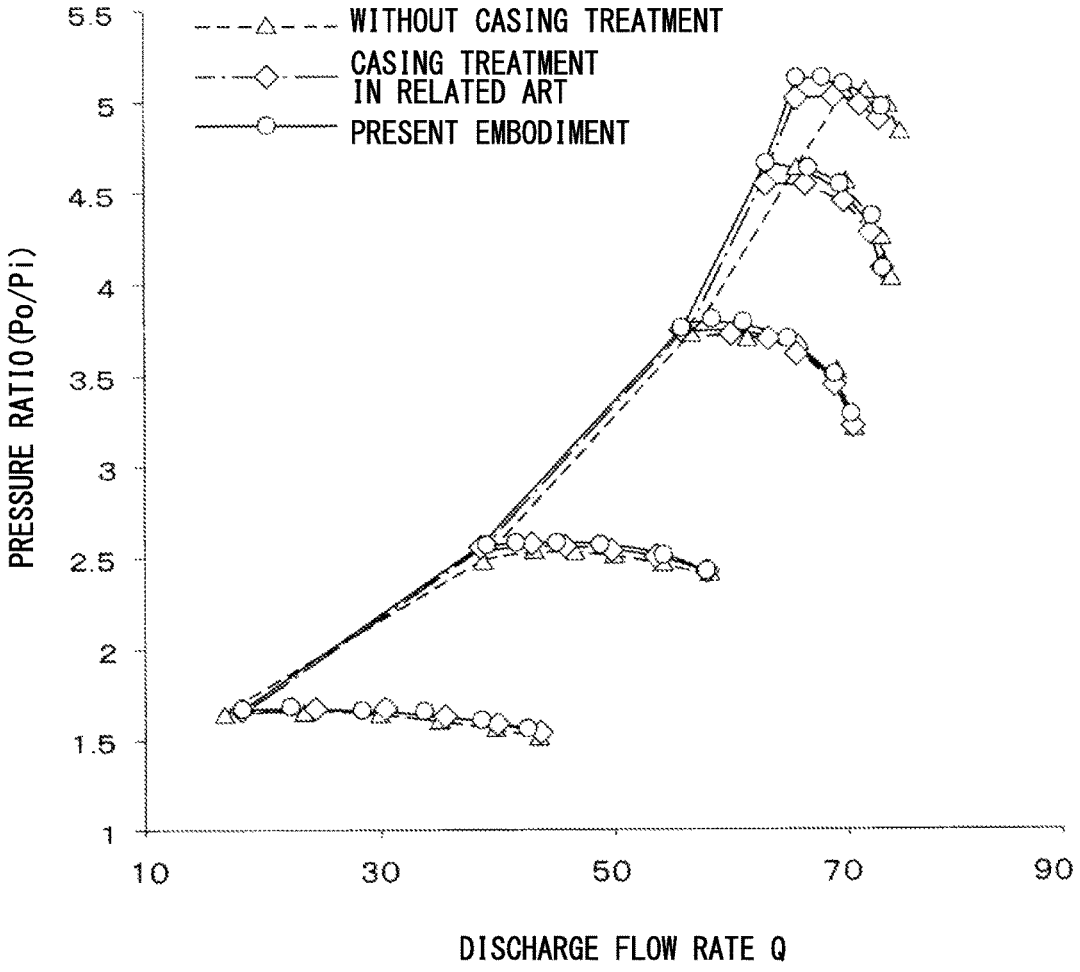
FIG. 5 is a graph showing a relationship between performance of casing treatment and operation characteristics of a centrifugal compressor.

FIG. 5 is a graph showing a relationship between performance of casing treatment and operation characteristics of a centrifugal compressor, the horizontal axis thereof represents a discharge flow rate (Q), and the vertical axis thereof represents a pressure ratio (Po/Pi: Po representing a fluid outflow section pressure, Pi representing a fluid inflow section pressure).

In FIG. 5, three curves are shown at each of five places. In FIG. 5, triangle marks represent operation characteristics of a centrifugal compressor not performing casing treatment (that is, the compressor not including the annular chamber 11, the upstream groove 12 and the downstream groove 13). Square marks (diamond marks) represent operation characteristics of a centrifugal compressor performing casing treatment in the related art (that is, the compressor in which both of the upstream groove 12 and the downstream groove 13 are provided over the entire circumference). Circle marks represent operation characteristics of a centrifugal compressor including the downstream groove 13 of this embodiment. The above curves are formed by connecting the same marks. In addition, these curves indicate that the discharge pressure of a fluid is increased by gradually decreasing the flow rate of the fluid (leftward in FIG. 5), and that the flow rate starts being decreased from each of predetermined five flow rates. Moreover, the leftmost marks of the curves of the same marks are connected by straight lines. Since the leftmost mark of each curve indicates that surging of a compressor occurs therein, the left area of each straight line of FIG. 5 indicates that the surging occurs and the compressor cannot operate therein. That is, each straight line represents a surging limit value of a centrifugal compressor.

In FIG. 5, the straight lines connecting square marks and the straight lines connecting circle marks are shown at approximately the same positions. Accordingly, in this embodiment, a surging-suppressing effect similar to that of the centrifugal compressor performing casing treatment in the related art is obtained. In addition, the curves connecting circle marks are positioned more upward in FIG. 5 than the curves connecting triangle marks or square marks. Accordingly, in this embodiment, the discharge pressure at the outflow section of the impeller 3 while the flow rate of a fluid is low is increased compared to that of the compressor performing casing treatment in the related art and of the compressor not performing casing treatment. That is, in this embodiment, it is possible to operate in a higher-pressure ratio.

As a result, in this embodiment, even when performing casing treatment which reduces surging and extends the operation range of a compressor, it is possible to prevent the reduction of a discharge pressure and of a discharge flow rate while the flow rate of a fluid is low.

In addition, the position of the downstream groove 13 is set into the range of ±45° with respect to the position of the tongue portion 15, and thereby, compared to casing treatment in the related art, it is possible to increase a discharge pressure and a discharge flow rate without deteriorating the surging-suppressing effect. Moreover, in order to set a more appropriate position of the downstream groove 13 in the range of ±45°, it is preferable that the position be determined by calculation in view of the characteristics of the impeller 3, the capacity of the centrifugal compressor 1 or the like.

The shape, the combination or the like of each component shown in the above-described embodiment is an example, and additions, omissions, replacements, and other modifications of configurations can be adopted within the scope of and not departing from the gist of the present invention. The present invention is not limited to the above descriptions and is limited only by the scopes of the attached claims.

For example, in the above embodiment, the cross-sectional shape of the annular chamber 11 along a plane including the central axis of the rotary shaft 4 is formed in an oval shape extending in the central axis direction of the impeller 3. However, the present invention is not limited thereto, and the cross-sectional shape may be a rectangular shape, a circular shape, an elliptical shape or the like.

INDUSTRIAL APPLICABILITY

The present invention can be applied to a centrifugal compressor which increases the pressure of a compressible fluid.

DESCRIPTION OF REFERENCE SIGNS

1 centrifugal compressor
2 casing
3 impeller
4 rotary shaft
5 annular flow passageway
6 inlet
7 diffuser
8 partition wall
9 outlet
11 annular chamber
12 upstream groove
13 downstream groove
14 impeller-accommodating portion
15 tongue portion

The invention claimed is:

1. A centrifugal compressor comprising:
an impeller; and
a casing accommodating the impeller,
wherein the casing includes:
an inlet;

an impeller-accommodating portion, the impeller being disposed in the impeller-accommodating portion;

an annular flow passageway formed around the impeller;

an outlet communicating with the annular flow passageway;

an annular chamber formed around the inlet;

a downstream groove communicating a downstream end portion of the annular chamber with the impeller-accommodating portion; and an upstream groove communicating an upstream end portion of the annular chamber to the inlet, wherein:

the casing includes a tongue portion formed between the outlet and the annular flow passageway, the downstream groove is formed within a range from a position of 45° upstream with respect to a reference radial line, connecting a rotation center of the impeller and the tongue portion, to a position of 75° downstream with respect to the reference radial line, and is not formed within another range, and the upstream groove extends around an entire circumference of the inlet.

2. The centrifugal compressor according to claim 1, wherein the downstream groove has a width in the circumferential direction of greater than or equal to 60° and less than or equal to 90°.

3. The centrifugal compressor according to claim 1, wherein the annular chamber extends around the entire circumference of the inlet.

4. A centrifugal compressor comprising:

an impeller; and a casing accommodating the impeller and including:

an inlet;

a downstream groove formed on a wall surface of the casing adjacent to an upstream end of the impeller;

an annular chamber; and an upstream groove communicating the annular chamber to the inlet, wherein:

the downstream groove is formed within a range from −45° to +75° and is not formed within another range, a position of a tongue portion of the compressor is 0°, an opposite position to the tongue portion across a rotation center of the impeller is 180°, a position shifted in a clockwise direction from the tongue portion is represented by a positive value of an angle, and a position shifted in a counter-clockwise direction from the tongue portion is represented by a negative value of an angle, a recirculation flow is formed through the downstream groove and the upstream groove, and the upstream groove extends around an entire circumference of the inlet.

5. The centrifugal compressor according to claim 4, wherein the downstream groove has a width in the circumferential direction of greater than or equal to 60° and less than or equal to 90°.

6. The centrifugal compressor according to claim 4, wherein the annular chamber extends around the entire circumference of the inlet.

* * * * *